US008717343B2

(12) United States Patent
Lee et al.

(10) Patent No.: US 8,717,343 B2
(45) Date of Patent: May 6, 2014

(54) REPAIR AMPLIFICATION CIRCUIT AND METHOD FOR REPAIRING DATA LINE

(75) Inventors: Chen-Tung Lee, Tainan County (TW); Ying-Lin Fang, Tainan County (TW)

(73) Assignee: Himax Technologies Limited, Tainan (TW)

( * ) Notice: Subject to any disclaimer, the term of this patent is extended or adjusted under 35 U.S.C. 154(b) by 774 days.

(21) Appl. No.: 12/948,086

(22) Filed: Nov. 17, 2010

(65) Prior Publication Data

US 2012/0119829 A1 May 17, 2012

(51) Int. Cl.
*G09G 5/00* (2006.01)

(52) U.S. Cl.
USPC ..... 345/209; 345/96; 345/100; 330/124 R

(58) Field of Classification Search
USPC ..... 330/124 R
See application file for complete search history.

(56) References Cited

U.S. PATENT DOCUMENTS

2005/0174316 A1* 8/2005 Kang ..... 345/100

FOREIGN PATENT DOCUMENTS

| | | |
|---|---|---|
| CN | 100498916 C | 6/2009 |
| CN | 101882426 A | 11/2010 |
| KR | 100929678 | 11/2009 |
| TW | 200905342 | 2/2009 |
| TW | 200909914 | 3/2009 |

OTHER PUBLICATIONS

"Office Action of Taiwan Counterpart Application", issued on Nov. 8, 2013, p. 1-p. 4.

* cited by examiner

*Primary Examiner* — Alexander Eisen
*Assistant Examiner* — Robin Mishler
(74) *Attorney, Agent, or Firm* — J.C. Patents

(57) ABSTRACT

A repair amplification circuit includes a controlling unit, a first operational amplifier, a second operational amplifier, a first switching unit, and a second switching unit. Under a detection mode, the controlling unit generates a detecting signal according to a testing signal transmitted by a unnecessary repair segment in a test picture. Under an operation mode, the controlling unit generates a switching signal according to a repair controlling signal related to the detecting signal. The first switching unit and the second switching unit are controlled by the switching signal, so as to transmit the driving signal to one of the first operational amplifier and the second operational amplifier, and to transmit a positive polarity repairing signal generated by the first operational amplifier or a negative polarity repairing signal generated by the second operational amplifier to a necessary repair segment.

11 Claims, 3 Drawing Sheets

REPAIR AMPLIFICATION CIRCUIT AND METHOD FOR REPAIRING DATA LINE

BACKGROUND OF THE INVENTION

1. Field of the Invention

The invention is related to a repair amplification circuit and a method for repairing a data line, and in particular to a repair amplification circuit and a method for repairing a data line for a display device.

2. Description of Related Art

As technologies advance, electronic devices have become ubiquitous in the daily lives of people, and display devices have become an important media through which people obtain information. Generally, a display device includes a display panel which displays images and a driving circuit which controls the display panel. The driving circuit provides driving signals to pixels in the display panel through data lines, so that the display panel displays images.

When manufacturing a display device, problems of broken data lines often occur. When a data line in a display panel is broken, the broken data line forms at least two data line segments, wherein one of the data line segments is still able to receive the driving signal, and another one of the data line segments is unable to receive the driving signal. In other words, since the data line is broken, some of the pixels in the display panel are unable to receive the driving signal, so that the display panel cannot display pictures normally.

In order to solve the above problem, a repair operation amplifier may be disposed in the display device. When the data line is broken into two data line segments, a testing engineer uses laser technology to solder an input end of the repair operation amplifier to the data line segment which is able to receive the driving signal, and to solder an output end of the repair operation amplifier to the data line segment which is unable to receive the driving signal. Hence, the data line segment which was previously unable to receive the driving signal become capable of receiving the driving signal provided by the source driver through the repair operation amplifier.

Generally, the driving signals provided by the source driver are classified as having a positive polarity and a negative polarity, so that conventional repair operation amplifiers are realized by using high voltage (such as 32 V) fabrication technologies, so that the driving signals output by the amplifiers cover two polarities (such as −5 V−5 V). However, the repair operation amplifiers realized by using high voltage fabrication technologies usually increase hardware costs of the display device. In addition, since operational amplifiers in the source driver of the display device are realized by using middle voltage (such as 5 V) fabrication technologies, not only is it difficult to integrate a conventional repair operation amplifier with a source driver, a conventional repair operation amplifier also requires a larger driving current compared with a source driver.

SUMMARY OF THE INVENTION

The disclosure provides a repair amplification circuit which uses two operational amplifiers to respectively process driving signals of different polarities, so that the two operational amplifiers are able to be realized by middle voltage fabrication technologies.

The disclosure provides a method for repairing a data line, thereby reducing hardware costs of the device.

The disclosure provides a repair amplification circuit for repairing a data line in a display device, wherein the data line includes a necessary repair segment and a unnecessary repair segment which are not electrically connected, and the repair amplification circuit includes a controlling unit, a first operational amplifier, a second operational amplifier, a first switching unit, and a second switching unit. Under a detection mode, the controlling unit generates a detecting signal according to a testing signal transmitted by the unnecessary repair segment in a test picture. Under an operation mode, the controlling unit generates a switching signal according to a repair controlling signal related to the detecting signal.

In addition, the first operational amplifier and the second operational amplifier are respectively used to generate a positive polarity repairing signal and a negative polarity repairing signal. The first switching unit receives a driving signal transmitted by the unnecessary repair segment in an image picture, and transmits the driving signal to one of the first operational amplifier and the second operational amplifier according to the switching signal. The second switching unit transmits the positive polarity repairing signal or the negative polarity repairing signal to the necessary repair segment according to the switching signal.

According to an embodiment of the disclosure, the first operational amplifier is operated in a first operational voltage, the second operational amplifier is operated in a second operational voltage, and the first operational voltage and the second operational voltages have opposite voltage polarities.

According to an embodiment of the disclosure, the above controlling unit includes a repair controller and a repair detector. Under the detection mode, the repair controller generates a detection enabling signal. In addition, under the operation mode, the repair controller generates the switching signal according to the repair controlling signal. Moreover, the repair detector starts to detect the testing signal according to the detection enabling signal, and generates the detecting signal according to a detection result.

From another point of view, the disclosure provides a method for repairing a data line, wherein the data line includes a necessary repair segment and a unnecessary repair segment which are not electrically connected, and the method for repairing the data line comprises: under a detection mode, generating a test data corresponding to a test picture, and detecting a testing signal transmitted by the unnecessary repair segment in the test picture; under an operation mode, generating a picture data corresponding to an image picture, and generating a repair controlling signal according to the detecting signal and a polarity controlling signal; generating a switching signal according to the repair controlling signal, and receiving a driving signal transmitted by the unnecessary repair segment in the image picture; transmitting the driving signal to one of a first operational amplifier and a second operational amplifier according to the switching signal, so as to generate a positive polarity repairing signal or a negative polarity repairing signal; and transmitting the positive polarity repairing signal or the negative polarity repairing signal to the necessary repair segment according to the switching signal.

In light of the above, the disclosure provides two operational amplifiers to respectively process driving signals of different polarities, so that the two operational amplifiers in the repair amplification circuit are able to be realized by middle voltage fabrication technologies. Therefore, the repair amplification circuit is easily integrated with the source driver and has better circuit characteristics, and is also beneficial to reducing hardware costs of the device. Furthermore, the repair amplification circuit according to the disclosure has automatic detection mechanisms, so no additional configuration of the repair amplification circuit is required before it is operated.

In order to make the aforementioned and other objects, features and advantages of the disclosure comprehensible, embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1A:
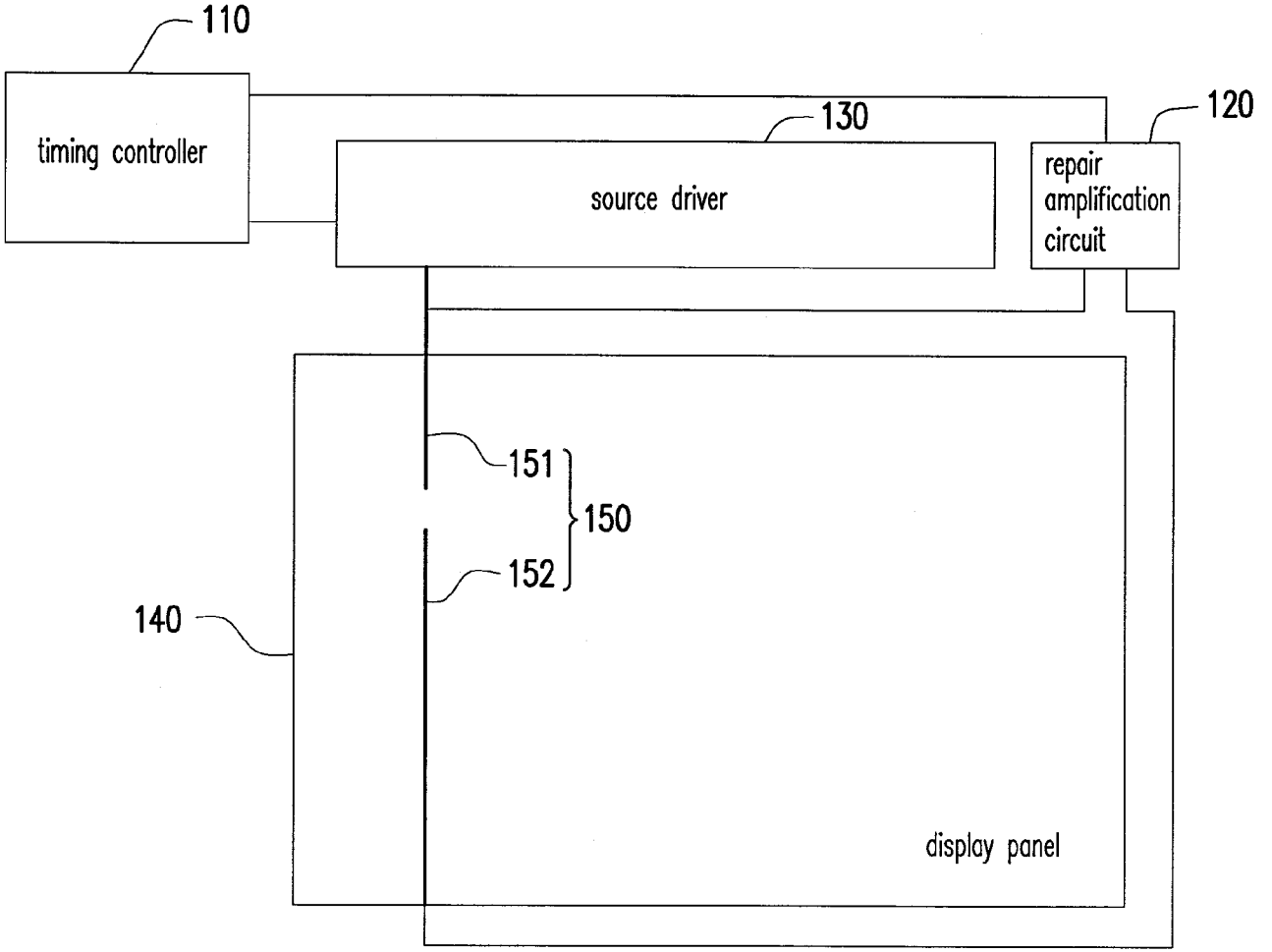
FIG. 1A is a schematic diagram of a display device according to an embodiment of the disclosure.

FIG. 1A is a schematic diagram of a display device according to an embodiment of the disclosure. Referring to FIG. 1A, a display device 100 includes a timing controller 110, a repair amplification circuit 120, a source driver 130 and a display panel 140. When a data line 150 is broken into two data line segments 151 and 152, the data line segment 151 is still capable of receiving a signal output from the source driver 130 and is defined as a unnecessary repair segment. Another data line segment 152 cannot receive the signal output from the source driver 130 and is defined as a necessary repair segment.

Moreover, in order to make the broken data line 150 completely receive the signal from the source driver 130, the repair amplification circuit 120 receives a signal from the unnecessary repair segment 151 (such as a testing signal STE1 and a driving signal SDR1) and processes the received signal or transmits a signal to the necessary repair segment 152. Hence, the necessary repair segment 152 is capable of normally receiving the signal from the source driver 130, so that the display device 100 is able to normally display pictures.

Figure 1B:
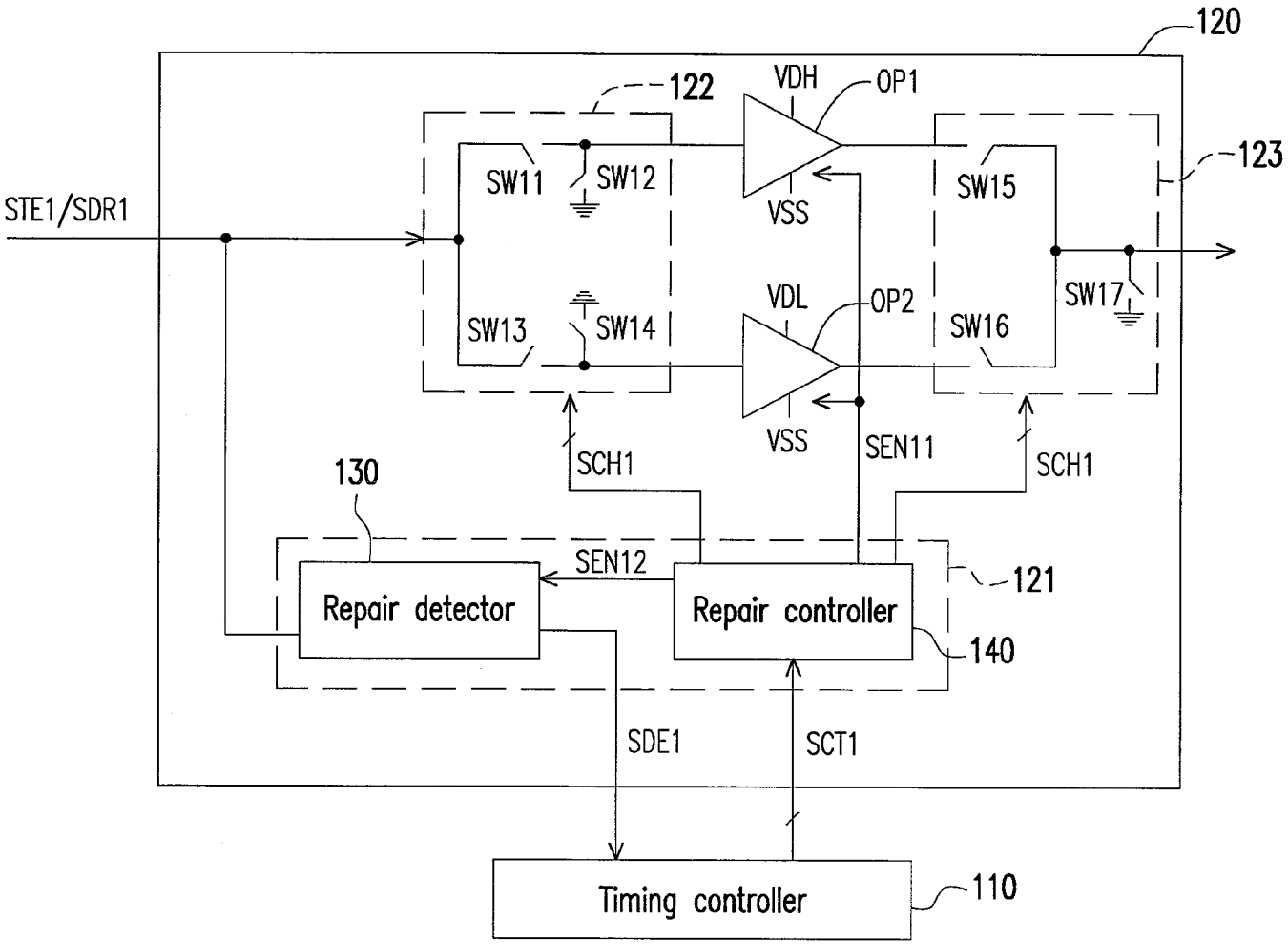
FIG. 1B is a schematic diagram of a repair amplification circuit according to an embodiment of the disclosure.

FIG. 1B is a schematic diagram of a repair amplification circuit according to an embodiment of the disclosure, in which the timing controller 110 is further illustrated. As shown in FIG. 1B, the repair amplification circuit 120 includes a controlling unit 121, a first operational amplifier OP1, a second operational amplifier OP2, a first switching unit 122, and a second switching unit 123. In addition, the controlling unit 121 includes a repair detector 130 and a repair controller 140. The first switching unit 122 includes switches SW11-SW14, and the second switching unit 123 includes switches SW15-SW17.

In the first switching unit 122, a first end of the switch SW11 and a first end of the switch SW13 are used to receive the signal transmitted from the unnecessary repair segment 151. A second end of the switch SW11 is electrically connected to an input end of the first operational amplifier OP1, and a second end of the switch SW13 is electrically connected an input end of the second operational amplifier OP2. A first end of the switch SW12 is electrically connected to the second end of the switch SW11, and a second end of the switch SW12 is electrically connected to a ground. A first end of the switch SW14 is electrically connected to the second end of the switch SW13, and a second end of the switch SW14 is electrically connected to the ground.

Operationally, the switches SW11-SW14 determine whether or not to conduct the first and second ends thereof according to a switching signal SCH1. According to the present embodiment, when the switch SW11 is turned on, the switch SW12 is turned off. Similarly, when the switch SW13 is turned on, the switch SW14 is turned off. Furthermore, the first switching unit 122 turns on one of the switches SW11 and SW13 according to the switching signal SCH1.

Therefore, in overall operations of the repair amplification circuit 120, the first switching unit 122 transmits the signal (such as the driving signal SDR1) which is received by the first switching unit 122 to one of the first operational amplifier OP1 and second operational amplifier OP2. In addition, when transmitting the signal to the first operational amplifier OP1, the first switching unit 122 further connects the input end of the second operational amplifier OP2 to the ground. Similarly, when transmitting the signal to the second operational amplifier OP2, the first switching unit 122 further connects the input end of the first operational amplifier OP1 to the ground.

In the second switching unit 123, a first end of the switch SW15 is electrically connected to an output end of the first operational amplifier OP1, and a second end of the switch SW15 is used to transmit the signal to the necessary repair segment 152. A first end of the switch SW16 is electrically connected to an output end of the second operational amplifier OP2, and a second end of the switch SW16 is electrically connected to the second end of the switch SW15. Additionally, a first end of the switch SW17 is electrically connected to the second end of the switch SW15, and a second end of the switch SW17 is electrically connected to a ground.

Operationally, the switches SW11-SW17 determine whether or not to conduct the first and second ends thereof according to the switching signal SCH1. According to the present embodiment, when the switch SW15 is turned on, the switch SW16 is turned off. Moreover, when the switches SW15 and SW16 are both turned off, the switch SW17 is turned on so as to precharge the necessary repair segment 152. In other words, the second switching unit 123 connects the output end of the first operational amplifier OP1 or the output end of the second operational amplifier OP2 to the necessary repair segment 152.

Moreover, since the first switching unit 122 and the second switching unit 123 are both controlled by the switching signal SCH1, operations of both are complementary with each other. According to the present embodiment, when the signal received by the first switching unit 122 is transmitted to the first operational amplifier OP1, the second switching unit 123 correspondingly transmits a signal output from the first operational amplifier OP1 to the necessary repair segment 152. On the other hand, when the signal received by the first switching unit 122 is transmitted to the second operational amplifier OP2, the second switching unit 123 correspondingly transmits a signal output from the second operational amplifier OP2 to the necessary repair segment 152.

In other words, the signal transmitted from the unnecessary repair segment 151 is amplified by one of the first operational amplifier OP1 and the second operational amplifier OP2, and the amplified signal is transmitted to the necessary repair segment 152. That is to say, in the broken data line 150, the signal that could have been received by the data line 150 is amplified by one of the first operational amplifier OP1 and the second operational amplifier OP2, and then is transmitted to the data line segment which is unable to receive signals.

It should be noted that according to the present embodiment, the first operational amplifier OP1 and the second operational amplifier OP2 use a voltage VSS (such as 0 V) as a baseline, and are operated respectively in a first operational voltage VDH (such as 5 V) and a second operational voltage VDL (such as −5 V). The first operational voltage VDH and the second operational voltage VDL have opposite polarities. Therefore, the first operational amplifier OP1 is used to generate a positive polarity repairing signal, and the second operational amplifier OP2 is used to generate a negative polarity repairing signal.

In other words, the two operational amplifiers OP1 and OP2 in the repair amplification circuit 120 may be realized by medium voltage fabrication technologies. The operational amplifiers in the repair amplification circuit 120 and operational amplifiers in the source driver 130 have similar direct current, alternating current, and transition mode characteristics, so that the repair amplification circuit is easily integrated with the source driver 130 and has better circuit characteristics. Additionally, the repair amplification circuit 120 is beneficial to reducing hardware costs of the device.

On the other hand, the driving signal SDR1 transmitted by the source driver 130 to the data line 150 includes a positive polarity and a negative polarity. Therefore, in terms of signal transmission, the repair amplification circuit 120 further includes an automatic detection mechanism, so as to control the first switching unit 122 and the second switching unit 123 according to a detection result. Through switching by the first switching unit 122 and the second switching unit 123, the driving signal SDR1 which has a positive polarity is, transmitted to the first operational amplifier OP1, and the driving signal SDR1 which has a negative polarity is transmitted to the second operational amplifier OP2.

According to the present embodiment, a reason that the repair amplification circuit 120 is able to correctly and timely transmit the driving signals SDR1 which have different polarities to the different operational amplifiers is mainly because of the fact that when the display device 100 is just turned on, the controlling unit 121 in the repair amplification circuit 120 detects properties of the broken data line 150, such as whether the broken data line 150 is an odd-numbered or even-numbered data line, and the detection result is recorded in the timing controller 110. Therefore, when the display device displays an image picture, the timing controller 110 is able to generate a suitable repair controlling signal SCT1 to the repair amplification circuit 120 according to the detection result and a polarity controlling signal. Wherein, the polarity controlling signal is signal for definining a polarity of the driving signal SDR1 provided by the source driver 130.

Figure 2:
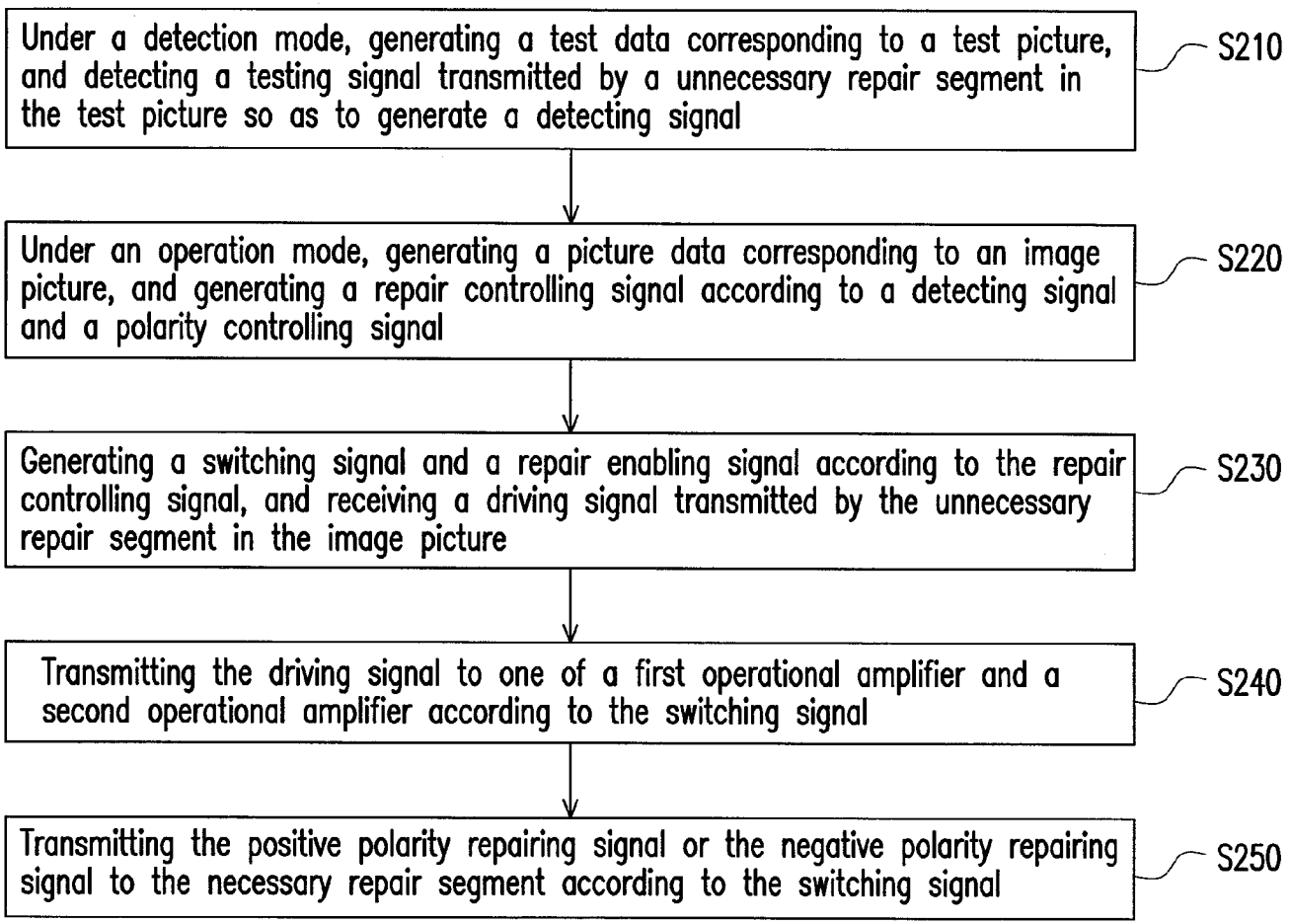
FIG. 2 is a schematic flowchart of a method for repairing a data line according to an embodiment of the disclosure.

For ease of description, FIG. 2 is a schematic flowchart of a method for repairing a data line according to an embodiment of the disclosure. Please refer to both FIGS. 1B and 2 for detailed operations of repairing the data line in the display device 100.

In the beginning, as shown in a step S210, under a detection mode, a test data corresponding to a test picture is generated, and the testing signal STE1 transmitted by the unnecessary repair segment 151 in the test picture is detected. Then, a detecting signal SDE1 is generated according to a detection result. For example, when the display device 100 is just turned on, it is switched to the detection mode. Under the detection mode, the timing controller 110 generates the test data corresponding to the test picture, so that the source driver 130 outputs a positive polarity voltage to even-numbered data lines and outputs a negative polarity voltage to odd-numbered data lines. In addition, under the detection mode, the repair controller 140 generates a detection enabling signal SEN12 to the repair detector 130.

The repair detector 130 thereby starts to detect the testing signal STE1 transmitted by the unnecessary repair segment 151 according to the detection enabling signal SEN12. If the broken data line 150 is an even-numbered data line, the testing signal STE1 is a positive polarity voltage, so that the repair detector 130 transmits a detecting signal SDE1 with a logic 1 back to the timing controller 110. Moreover, if the broken data line 150 is an odd-numbered data line, the testing signal STE1 is a negative polarity voltage, so that the repair detector 130 transmits the detecting signal SDE1 with a logic 0 back to the timing controller 110. In terms of detection times configuration, the repair detector 130 may transmit a plurality of detecting signals SDE1 to the timing controller 110 by repeatedly detecting the unnecessary repair segment 151 for a plurality of times (such as 11 times) within a time interval. Therefore, the timing controller 110 is able to average the plurality of detecting signals SDE1, so as to avoid miscalculation of the detecting signal SDE1 due to interference.

In addition, as shown in a step S220, under an operation mode, a picture data corresponding to an image picture is generated, and the repair controlling signal SCT1 is generated according to the detecting signal SDE1 and the polarity controlling signal. For instance, under the operation mode, the timing controller 110 generates the picture data corresponding to the image picture. In addition, the timing controller 110 determines whether the broken data line 150 is an odd-numbered or even-numbered data line according to the detecting signal SDE1. Therefore, according to the polarity controlling signal, the timing controller 110 is able to further determine whether the driving signal SDR1 transmitted by the unnecessary repair segment 151 in the image picture has a positive or negative polarity, so as to generate the suitable repair controlling signal SCT1 to the repair amplification circuit 120.

Then, as shown in a step S230, the switching signal SCH1 and the repair enabling signal SEN1 are generated according to the repair controlling signal SCT1, and the driving signal SDR1 transmitted by the unnecessary repair segment 151 in the image picture is received. For example, the repair controller 140 generates the repair enabling signal SEN1 according to the repair controlling signal SCT1, so as to enable the first operational amplifier OP1 and the second operational amplifier OP2. In addition, the repair controller 140 generates the switching signal SCH1 according to the repair controlling signal SCT1. On the other hand, under circumstances in which image pictures are normally displayed by the display device 100, the first switching unit 122 is able to receive the driving signal SDR1 transmitted by the unnecessary repair segment 151 in the image picture.

Afterwards, as shown in steps S240 and S250, the driving signal SDR1 is transmitted to one of the first operational amplifier OP1 and the second operational amplifier OP2 according to the switching signal SCH1, and the positive polarity repairing signal or the negative polarity repairing signal is transmitted to the necessary repair segment 152 according to the switching signal SCH1. For example, when the driving signal SDR1 has a positive polarity, the first switching unit 122 transmits the driving signal SDR1 to the first operational amplifier OP1, so that the first operational amplifier OP1 generates the positive polarity repairing signal. In addition, the second switching unit 123 transmits the positive polarity repairing signal to the necessary repair segment 152. On the other hand, when the driving signal SDR1 has a negative polarity, the first switching unit 122 transmits the driving signal SDR1 to the second operational amplifier OP2, so that the second operational amplifier OP2 generates the negative polarity repairing signal. In addition, the second switching unit 123 transmits the negative polarity repairing signal to the necessary repair segment 152.

In summary, according to the disclosure, the two operational amplifiers are used to respectively process the driving signals which have different polarities. Therefore, the two operational amplifiers in the repair amplification circuit may be realized by medium voltage fabrication technologies. Hence, the operational amplifiers in the repair amplification circuit and the operational amplifiers in the source driver have similar direct current, alternating current, and transition mode characteristics, so that the repair amplification circuit is easily integrated with the source driver and has better circuit characteristics. Additionally, the repair amplification circuit according to the disclosure is beneficial to reducing hardware costs of the device. Furthermore, the repair amplification circuit according to the disclosure has automatic detection mechanisms, so no additional configuration of the repair amplification circuit is required before it is operated.

It will be apparent to those skilled in the art that various modifications and variations can be made to the disclosure without departing from the scope or spirit of the disclosure. In view of the foregoing, it is intended that the disclosure cover modifications and variations of this disclosure provided they fall within the scope of the following claims and their equivalents.

What is claimed is:

1. A repair amplification circuit, for repairing a data line in a display device, wherein the data line comprises a necessary repair segment and a unnecessary repair segment which are not electrically connected, and the repair amplification circuit comprises:

a controlling unit, wherein under a detection mode, the controlling unit generates a detecting signal according to a testing signal transmitted by the unnecessary repair segment in a test picture, and under an operation mode, the controlling unit generates a switching signal according to a repair controlling signal related to the detecting signal, the controlling unit further comprises:

a repair controller, generating a detection enabling signal under the detection mode, and generating the switching signal according to the repair controlling signal under the operation mode; and a repair detector, detecting the testing signal according to the detection enabling signal, and generating the detecting signal according to a detection result;

a first operational amplifier and a second operational amplifier, respectively generating a positive polarity repairing signal and a negative polarity repairing signal;

a first switching unit, receiving a driving signal transmitted by the unnecessary repair segment in an image picture, and transmitting the driving signal to one of the first operational amplifier and the second operational amplifier according to the switching signal; and a second switching unit, transmitting the positive polarity repairing signal or the negative polarity repairing signal to the necessary repair segment according to the switching signal.

2. The repair amplification circuit as claimed in claim 1, wherein the first operational amplifier is operated in a first operational voltage, the second operational amplifier is operated in a second operational voltage, and the first operational voltage and the second operational voltages have opposite voltage polarities.

3. The repair amplification circuit as claimed in claim 1, wherein the display device comprises a timing controller, and under the detection mode, the timing controller generates a test data corresponding to the test picture, and under the operation mode, the timing controller generates a picture data corresponding to the image picture, and generates the repair controlling signal according to the detecting signal and a polarity controlling signal.

4. The repair amplification circuit as claimed in claim 1, wherein the controlling unit further generates a repair enabling signal according to the repair controlling signal, so as to enable the first operational amplifier and the second operational amplifier.

5. The repair amplification circuit as claimed in claim 1, wherein when the driving signal is transmitted to the first operational amplifier, the first switching unit further electrically connects the input end of the second operational amplifier to a ground, and when the driving signal is transmitted to the second operational amplifier, the first switching further electrically connects the input end of the first operational amplifier to the ground.

6. The repair amplification circuit as claimed in claim 1, wherein the first switching unit comprises:

a first switch, having a first end receiving the driving signal, and a second end electrically connected to an input end of the first operational amplifier;

a second switch, having a first end electrically connected to the second end of the first switch, and a second end electrically connected to a ground;

a third switch, having a first end receiving the driving signal, and a second end electrically connected to an input end of the second operational amplifier; and a fourth switch, having a first end electrically connected to the second end of the third switch, and a second end electrically connected to the ground, wherein the first switch to the fourth switch determine whether or not to conduct the first ends and the second ends thereof according to the switching signal.

7. The repair amplification circuit as claimed in claim 1, wherein the second switching unit comprises:

a fifth switch, having a first end electrically connected to an output end of the first operational amplifier, and a second end electrically connected to the necessary repair segment;

a sixth switch, having a first end electrically connected to an output end of the second operational amplifier, and a second end electrically connected to the second end of the fifth switch;

a seventh switch, having a first end electrically connected to the second end of the fifth switch, and a second end electrically connected to the ground, wherein the fifth switch to the seventh switch determine whether or not to conduct the first ends and the second ends thereof according to the switching signal.

8. A method for repairing a data line, wherein the data line comprises a necessary repair segment and a unnecessary repair segment which are not electrically connected, and the method for repairing the data line comprises:

under a detection mode, generating a test data corresponding to a test picture, and detecting a testing signal transmitted by the unnecessary repair segment in the test picture so as to generate a detecting signal, wherein the step of detecting the testing signal transmitted by the unnecessary repair segment in the test picture so as to generate the detecting signal comprises:

generating a detection enabling signal;

detecting the testing signal according to the detection enabling signal, and generating a detection result accordingly; and generating the detecting signal according to the detection result;

under an operation mode, generating a picture data corresponding to an image picture, and generating a repair controlling signal according to the detecting signal and a polarity controlling signal;

generating a switching signal according to the repair controlling signal, and receiving a driving signal transmitted by the unnecessary repair segment in the image picture;

transmitting the driving signal to one of a first operational amplifier and a second operational amplifier according to the switching signal, so as to generate a positive polarity repairing signal or a negative polarity repairing signal; and transmitting the positive polarity repairing signal or the negative polarity repairing signal to the necessary repair segment according to the switching signal.

9. The method for repairing the data line as claimed in claim 8, wherein the first operational amplifier is operated in a first operational voltage, the second operational amplifier is operated in a second operational voltage, and the first operational voltage and the second operational voltages have opposite voltage polarities.

10. The method for repairing the data line as claimed in claim 8, further comprising:

generating a repair enabling signal according to the repair controlling signal, so as to enable the first operational amplifier and the second operational amplifier.

11. The method for repairing the data line as claimed in claim 8, wherein the step of transmitting the driving signal to one of the first operational amplifier and the second operational amplifier according to the switching signal comprises:

when transmitting the driving signal to the first operational amplifier, connecting an input end of the second operational amplifier to a ground; and when transmitting the driving signal to the second operational amplifier, connecting an input end of the first operational amplifier to the ground.

* * * * *